US006812442B2

(12) United States Patent
Kim et al.

(10) Patent No.: US 6,812,442 B2
(45) Date of Patent: Nov. 2, 2004

(54) MICROWAVE OVEN DOOR WITH CHOKE STRUCTURE

(75) Inventors: Eung-Soo Kim, Seoul (KR); Yang-Kyeong Kim, Bucheon (KR); Young-Min Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/414,232

(22) Filed: Apr. 16, 2003

(65) Prior Publication Data

US 2004/0079751 A1 Apr. 29, 2004

(30) Foreign Application Priority Data

Oct. 24, 2002 (KR) ..... 10-2002-0065350

(51) Int. Cl.[7] ..... H05B 6/76
(52) U.S. Cl. ..... 219/742; 219/743; 174/35 GC
(58) Field of Search ..... 219/743, 742, 219/741, 744, 739; 174/35 R, 35 GC, 35 MS

(56) References Cited

U.S. PATENT DOCUMENTS 5,705,797 A * 1/1998 Seo ..... 219/742
5,750,969 A * 5/1998 Lee ..... 219/742

FOREIGN PATENT DOCUMENTS

JP 52-19341 * 2/1977 ..... 219/741

* cited by examiner

*Primary Examiner*—Philip H. Leung
(74) *Attorney, Agent, or Firm*—Greenblum & Bernstein, P.L.C.

(57) ABSTRACT

A door of a microwave oven comprising: a door panel which is installed on a front surface of a casing having a cavity corresponding to a cooking space of food to be opened and closed; a door frame which is combined with the door panel to be located at a front of the cavity; a choke cover which is inserted in the door frame, for covering a choke seal; and a frame subsidiary plate which is positioned to opposed to the choke cover and is combined with the door frame to remove a gap formed between the choke cover and a lateral surface of the door frame.

3 Claims, 5 Drawing Sheets

MICROWAVE OVEN DOOR WITH CHOKE STRUCTURE

BACKGROUND OF THE INVENTION

1. Field of the Invention

The present invention relates to a door of a microwave oven and particularly, to a door of a microwave oven, capable of preventing staining with foreign materials such as food remnants between a door frame and a choke cover and effectively chocking electromagnetic waves.

2. Description of the Related Art

Generally, a microwave oven is a cooking device for heating a cooking object by activating intermolecular movement by penetrating microwave in the cooking object.

FIG. 1 is a perspective view showing a microwave oven in accordance with the conventional art, FIG. 2 is a sectional view taken along line I—I of FIG. 1, FIG. 3 is an enlarged view of "A" portion of FIG. 2, and FIG. 4 is an LC resonance circuit of the conventional microwave oven.

As shown in the drawing, the conventional microwave oven includes a casing 1 which forms a shape of the oven, a cavity 2 which is formed as a cooking space to cook food inside the casing 1, and a door 3 which is rotatably combined with a side of the casing 1, for opening and closing a front portion of the cavity 2.

The casing 1 is formed in a square box, and electromagnetic generators such as a magnetron and the like are positioned at a side therein. The cavity 2 is positioned at the other side therein.

An adjusting unit 4 for selecting various cooking modes is positioned on a front surface of the casing 1.

The door 3 is formed in a rectangular form identical as an opening portion of the cavity 2 and is positioned at the front of the casing 1 to open and close the cavity 2.

The door panel 5 of the door 3 is generally injected with synthetic resin and on the other hand a door frame 6 is formed with iron material.

A transparent window 7 is mounted at the central opening side of the door frame 6 to look into the inside of the cavity 2 from the outside thereof.

A choke seal S for preventing leakage of electromagnetic wave is formed at an edge of the door frame 6, and a choke cover 8 is combined with the door frame 6 to seal the choke seal S.

The usage and operation of the conventional microwave oven will be described as follows.

Firstly, a cooking object is put into the cavity 1 and the door 3 is closed. Then, when the microwave oven is operated by selecting the adjusting unit 4, the object is heated and cooked by electromagnetic wave generated in the magnetron and radiant heat generated in a halogen heater (not shown) installed in the cavity 2.

In the conventional microwave oven, a first capacitance C1 for chocking electromagnetic wave generated in the magnetron is formed between an end portion 6*a* of the door frame and the front surface 1*a* of the casing, an inductance L is formed at the end portion 6*a* of the door frame, and a second capacitance C2 is formed between the end 6*b* and a bent portion 6*c* of the door frame.

Also, the door frame 6 having a predetermined thickness is bent and formed in order to construct an LC resonance circuit. At this time, a part R having a predetermined radius is formed at the bent portion 6*c* of the door frame, so that a cap G is generated between an end portion of the choke cover 8 and the bent portion 6*c* of the door frame.

That is, in order to prevent the cap G from being generated between the end portion 8*a* of the choke cover and the bent portion 6*c* of the door frame, the end portion 8*a* of the choke cover and the adjacent bent portion 6*c* of the door frame have to be attached to each other flatly.

To this end, the choke cover 8 formed with material like synthetic resin can be fabricated with a flat shape, but the door frame 6 of iron plate material fabricated by bending has a difficulty in being fabricated with the flat shape and the bent part R can not help being generated at the bent position. According to this, even if the choke cover 8 is attached to the bent portion 6*c* of the door frame, the cap G is generated.

In case that he cap G is generated between the choke cover 8 and the bent portion 6*c* of the door frame, the gap is stained with foreign materials such as food remnants.

This phenomenon occurs more often in a large and high power (2 KW) microwave oven for company than a home microwave oven of low power (1 KW).

In case foreign materials are stained in the gap generated between the choke cover and the bent portion of the door frame, cleaning becomes very difficult and the foreign materials can not be completely removed but remain after cleaning, thus to cause hygienic severe problems.

SUMMARY OF THE INVENTION

Therefore, an object of the present invention is to provide a door of a s microwave oven, capable of solve hygienic problems by preventing foreign materials from being stained in a gap generated between a bent portion of the door frame and a choke cover by installing a frame subsidiary plate at one side of the door frame.

Another object of the present invention is to provide a door of a microwave oven, capable of efficiently chocking electromagnetic wave generated from a magnetron by properly adjusting a size of a capacitor.

To achieve these and other advantages and in accordance with the purpose of the present invention, as embodied and broadly described herein, there is provided a door of a microwave oven, including a door panel which is installed on a front surface of a casing to be opened and closed, a door frame which is inserted and combined with the door panel to be located at the front of the cavity, a transparent window which is mounted at a central opening side of the door frame to look into the inside of the cavity from the outside, a choke cover which is inserted in a bent portion of the door frame, for covering a choke seal, and a frame subsidiary plate which is installed at the door frame so as to remove a gap generated between the choke cover and the door frame.

The frame subsidiary plate includes a fixing portion which is fixed at a side of the door frame and a covering portion extended from an end of the fixing portion for covering the bent portion of the door frame.

The frame subsidiary plate maintains a predetermined space from the door frame.

To achieve these and other advantages and in accordance with the purpose of the present invention, as embodied and broadly described herein, there is also provided a door of a microwave oven comprising: a first inductance formed at one end of a door frame; a first capacitance formed between one end of the door frame and a front side of a casing; a second inductance formed between a short surface of the door frame and a frame subsidiary plate and an end of the frame subsidiary plate; and a second capacitance between the end of the frame subsidiary plate and an end of the door frame.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 5:
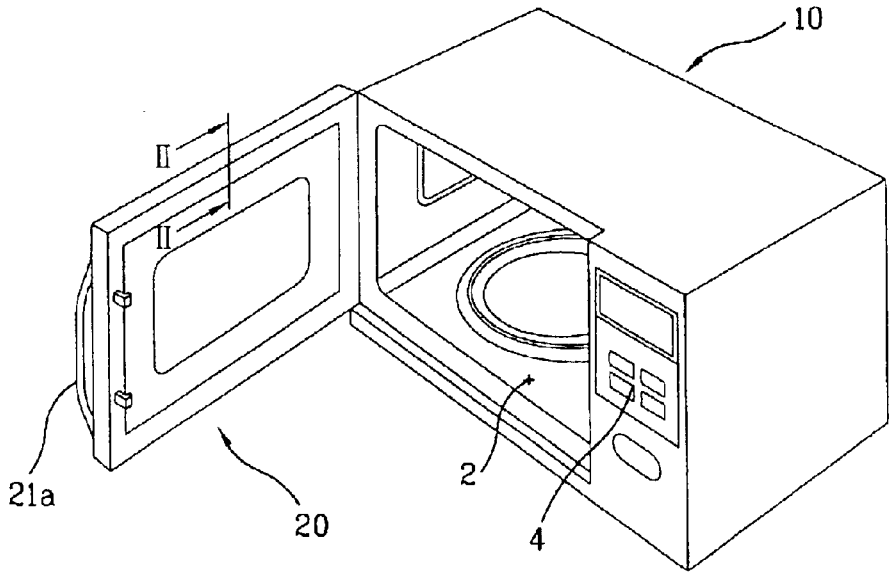
FIG. 5 is a perspective view showing a microwave oven in accordance with the present invention.
Figure 6:
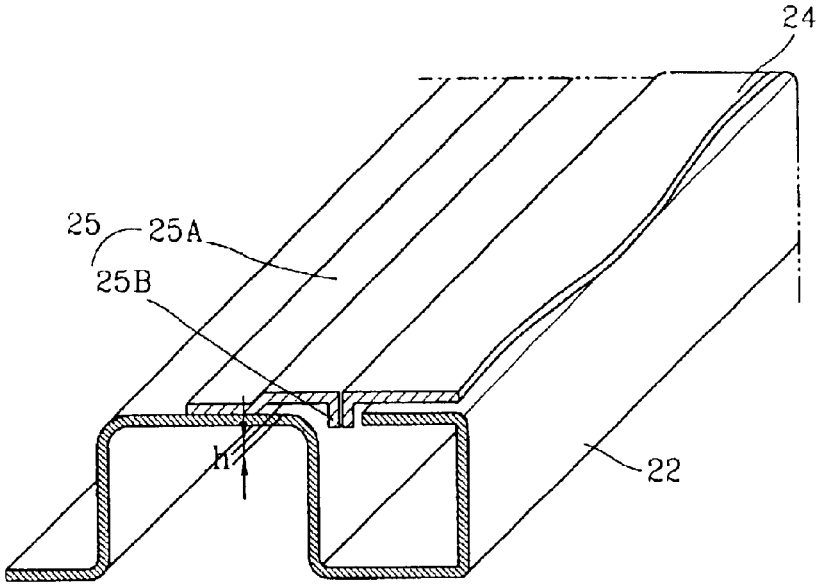
FIG. 6 is a partially cut perspective view showing an assembly location between a frame subsidiary plate installed in a door frame and a choke cover.
Figure 7:
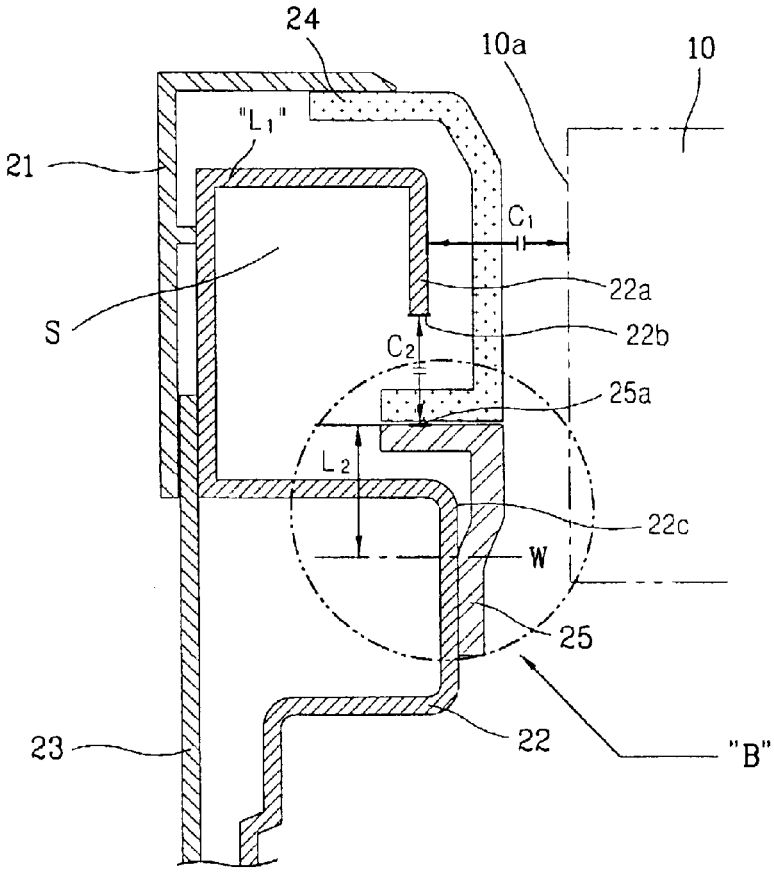
FIG. 7 is a sectional view taken along line II—II of FIG. 5 and an LC circuit diagram for describing a structure for chocking electromagnetic waves of the present invention.
Figure 8:
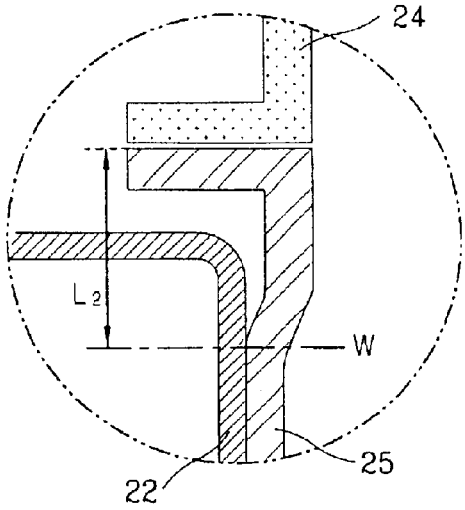
FIG. 8 is an enlarged view of "B" part of FIG. 7.
Figure 9:
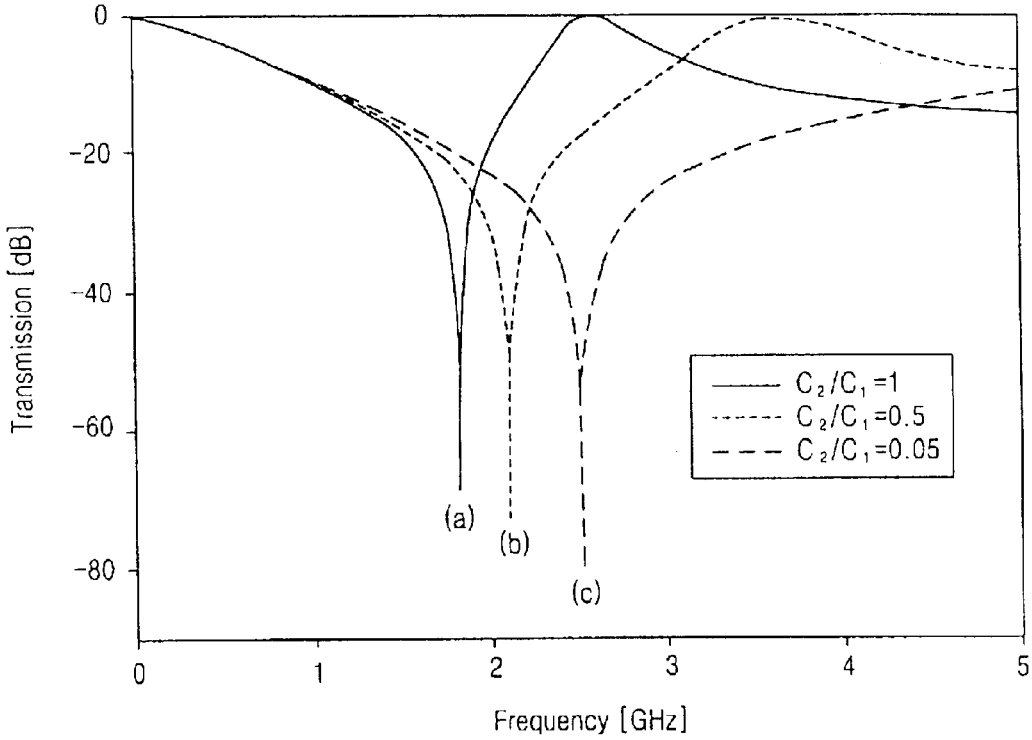
FIG. 9 is a graph showing a resonance characteristic of the present invention.

FIG. 5 is a perspective view showing a microwave oven in accordance with the present invention, FIG. 6 is a partially cut perspective view showing an assembly location between a frame subsidiary plate installed in a door frame and a choke cover, FIG. 7 is a sectional view taken along line II—II of FIG. 5 and an LC circuit diagram for describing a structure for chocking electromagnetic waves of the present invention, FIG. 8 is an enlarged view of "B" part of FIG. 7, and FIG. 9 is a graph showing a resonance characteristic of the present invention.

As shown in the drawing, the microwave oven of the present invention includes a casing 10 which forms a shape, a cavity 2 which is formed as a cooking space inside the casing 10 to cook food and a door 20 which is combined with a side of the casing 10, for opening and closing a front surface portion of the cavity 2.

The door 20 of the present invention includes a door panel 21 which is installed on a front surface of the casing 10 to be opened and closed, a door frame 22 which is inserted and combined with the door panel 21 to oppose to the front of the cavity 2, a transparent window 23 which is mounted at a central opening side of the door frame 22 to look into the inside of the cavity from the outside, a choke cover 24 which is inserted in a bent portion of the door frame 22, for covering a choke seal S and a frame subsidiary plate 25 which is positioned to oppose to the choke cover 24 and is combined with the door frame 22 to remove a gap formed between a bent portion of the choke cover and a bent end of the door frame.

The door panel 21 is manufactured with materials such as synthetic resin and a door handle 21*a* which can open and close the door is installed at a side of the front surface.

The door frame 22 is manufactured with a steel plate, is inserted and combined with the door panel 21, and bent-formed several times to form the choke seal S together with the choke cover 24.

The choke cover 24 is installed at a side surface of the door frame 22 to cover the choke seal S.

Figure 1:
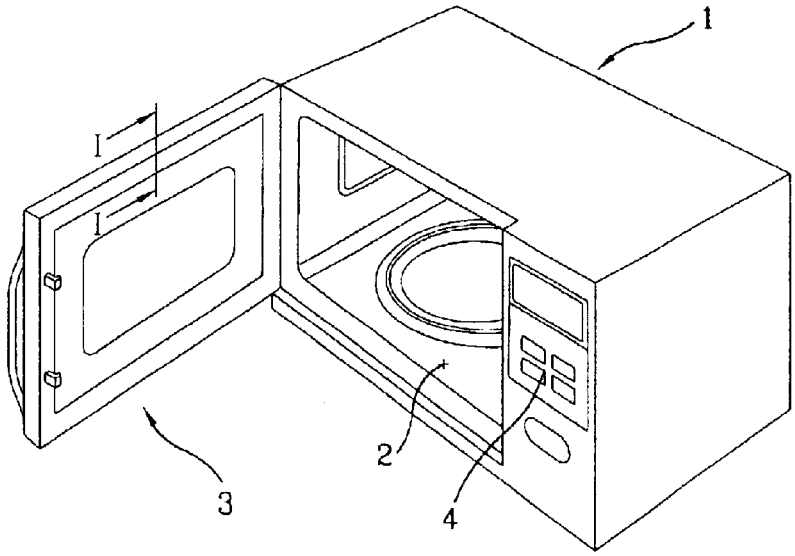
FIG. 1 CONVENTIONAL ART
FIG. 1 is a perspective view showing an embodiment of a conventional microwave oven.
Figure 2:
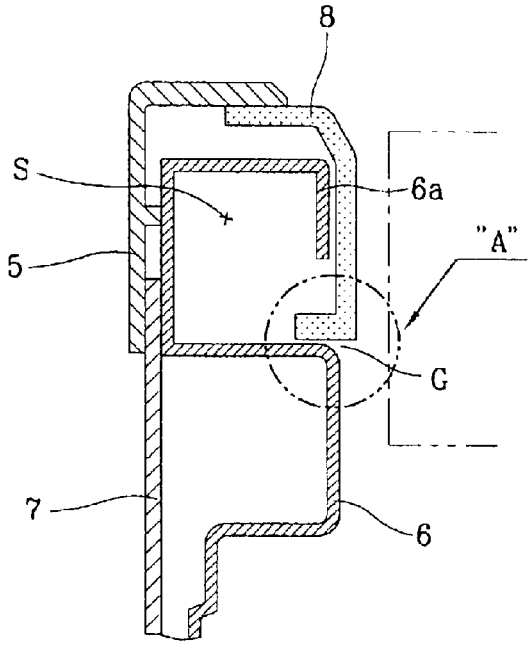
FIG. 2 CONVENTIONAL ART
FIG. 2 is a cross-sectional view taken along section line I—I of FIG. 1.
Figure 3:
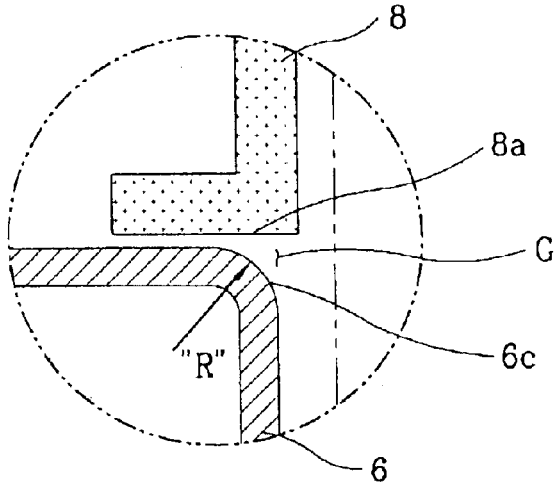
FIG. 3 CONVENTIONAL ART
FIG. 3 is a partially enlarged view of "A" portion of FIG. 2.
Figure 4:
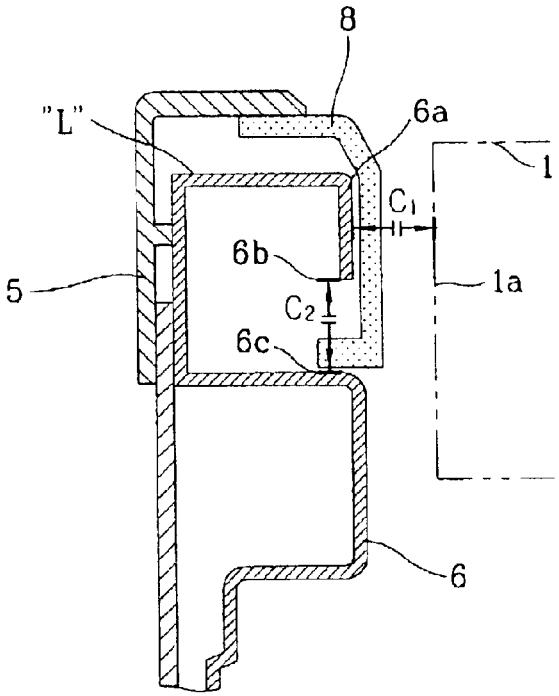
FIG. 4 CONVENTIONAL ART
FIG. 4 is a perspective view showing an LC resonance circuit of a microwave oven in accordance with the conventional art.

As shown in FIG. 3, a gap G is formed between an end portion of the choke cover 8 and a bent portion 6*c* of the door frame 8*a*, and in the present invention, a frame subsidiary plate 25 is further fixed and installed at a side of the door frame 22 to remove the gap G.

The frame subsidiary plate 25 is installed at a predetermined space h from the door frame 22.

The frame subsidiary plate 25 can be divided to two parts and those parts are a fixing portion 25A which is welded and fixed at a side of the door frame 22 and a covering portion 25B which removes the gap G by being extended from an end portion of the fixing portion 25A and thus covering a bent part 22*c* of the door frame 22.

A user cooks food with the microwave oven by opening the door 20, putting the food on a turntable inside the cavity 2 and selecting a proper button of the adjusting portion 4.

At this time, by covering the gap G (Referring to FIG. 3) formed between the choke cover 24 and the bent portion 22*c* of the door frame 22 with the covering portion 25B of the frame subsidiary plate 25, the gap G is removed. Therefore, the gap G is not stained with foreign materials such as food remnants, thus to maintain cleanliness.

As shown in FIGS. 7 and 8, in the LC resonance circuit for chocking electromagnetic waves generated from a magnetron, a first capacitance C1 is formed between the end portion 22*a* of the door frame and the front surface 10*a* of the casing, an inductance L1 is formed at the end portion 22*a* of the door frame, and a second capacitance C2 is formed between the end 22*b* of the door frame and the bent portion 22*c* of the door frame. Herein, the present invention considers a quality factor. According to this, the less the second capacitance becomes, the less the quality factor, and at this time, a chocking bandwidth of frequency becomes great, thus improves a chocking characteristic.

That is, the frame subsidiary plate 25 is installed at one side of the door frame 22 to cover the bent portion 22*c* of the door frame 22, thereby solving unsanitary problems by foreign material, decreasing the second capacitance C2 in the LC resonance circuit, increasing the second inductance L2, thus improving the electromagnetic waves chocking characteristics.

Hereinafter, the structure for chocking electromagnetic waves of the microwave oven in accordance with the present invention will be briefly described.

Generally, since electromagnetic waves (frequency 2.45 GHz) generated in a magnetron of a microwave oven are harmful to a human body and badly affect on another electronics products, the waves must not be leaked to the outside.

Therefore, in the present invention, the first capacitance C1 is formed between the end portion 22*a* of the door frame and the front surface 10*a* of the casing, and the first inductance L1 is formed at the end portion of the door frame in serial with the first capacitance C1. Also, the second capacitance C2 is formed between the end 22*b* of the door frame and an end 25*a* of the frame subsidiary plate, and the second inductance is formed between a short surface of the door frame 22 and the frame subsidiary plate 25 and the end 25*a* of the frame subsidiary plate.

In the present invention, the frame subsidiary plate 25 is installed differently from the conventional art, so that a size of the second capacitance C2 is decreased, the inductance L2 below λ/4 (λ denotes free space wavelength of used frequency) is formed from the short, surface, and thus the chocking characteristic of the electromagnetic waves is improved.

FIG. 9 is a graph illustrating a resonant characteristic of the present invention, and as shown in the drawing, a lengthwise shaft (X axis) indicates a frequency, and a breadthwise shaft (Y axis) indicates a transmitted amount of the electromagnetic waves normalized by incident wave. Curved lines a and b designate embodiments 1 and 2 by the conventional chocking structure, and a curved line c displays a graph by the chocking structure of the present invention.

As shown from the graph, the curved line a shows C2/C1=1, the curved line b shows C2/C1=0.5, and the curved line c shows C2/C1=0.05.

When the second capacitance C2 is gradually decreased, the quality factor (improvement coefficient) is lowered, and thus the electromagnetic waves chocking bandwidth is greatly widened. According to this, the electromagnetic waves are efficiently chocked not only in the home microwave oven of low power but also in the large and high power microwave oven for company.

As described above, in the present invention, unsanitary problems that the gap is stained by foreign material such as food remnant can be solved by removing the gap formed between the bent portion of the door frame and the choke cover, and the size of the second capacitance is properly adjusted, thereby enhancing the electromagnetic wave chocking bandwidth and thus efficiently chocking the electromagnetic wave.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A door of a microwave oven comprising:

a first capacitance formed between a door frame and a front side of a casing;

a first inductance formed at an end portion of the door frame in serial with the first capacitance;

a second capacitance formed between an end of the door frame and an end portion of a frame subsidiary plate; and a second inductance formed between a short surface of the door frame and the frame subsidiary plate and the end of the frame subsidiary plate.

2. The door of a microwave oven of claim 1, wherein the second inductance has a length below λ/4.

3. The door of a microwave oven of claim 1, wherein the first capacitance over the second capacitance is equal to 0.05.

* * * * *